United States Patent [19]

Rudy

[11] 4,050,439

[45] Sept. 27, 1977

[54] ACCURATE ADJUSTABLE SLING-SHOT

[75] Inventor: Christopher John Rudy, Midland, Mich.

[73] Assignee: Thresher Institutes Incorporated, Midland, Mich.

[21] Appl. No.: 629,103

[22] Filed: Nov. 6, 1975

[51] Int. Cl.[2] ..... F41B 7/00

[52] U.S. Cl. ..... 124/20 R

[58] Field of Search ..... 124/20 R, 20 A, 20 B, 124/25, 87, 88, 89, 80; 33/265; 43/19

[56] References Cited

U.S. PATENT DOCUMENTS

| | | | |
|---|---|---|---|
| 516,852 | 3/1894 | Trumble | 124/20 B |
| 1,207,025 | 12/1916 | Grigsby | 124/20 R |
| 2,807,254 | 9/1957 | Stribling | 124/20 R |
| 2,808,043 | 10/1957 | Lombard | 124/20 A UX |
| 2,820,444 | 1/1958 | Pedersen | 124/20 R |
| 2,825,323 | 3/1958 | Huszar | 124/20 R |
| 2,948,078 | 8/1960 | Miotke | 124/20 R |
| 3,614,947 | 10/1971 | Feldman | 124/20 B |
| 3,875,923 | 4/1975 | Horel | 124/20 R |
| 3,901,209 | 8/1975 | Woolsey et al. | 124/20 R |

*Primary Examiner*—Richard C. Pinkham
*Assistant Examiner*—William R. Browne
*Attorney, Agent, or Firm*—N. Jerome Rudy

[57] ABSTRACT

A sling-shot device comprises, in basic assembly, an enclosed, generally circular "tine" section or impeller holder fixed on the grip or handle portion of the assembly with provision in said circular "tine" section for angularly and rotatably adjusting the secured ends of the elastic power band or the like or equivalent sling or impeller member, said ends being mounted secure at more or less diametrically opposed points located circumferentially on said circular "tine" section so that at least substantially perpendicular aiming (or sighting) and "firing" of the sling-shot is facilitated regardless of the position assumed in operational holding of the sling-shot when other-than-perpendicular (to the ground) handle dispositions are encountered; this accommodating a natural and most comfortable and desired body stance and head-cocking positional relationship assumed because of individual physique, style and mannerism for any given shooter using the sling-shot.

36 Claims, 7 Drawing Figures

ACCURATE ADJUSTABLE SLING-SHOT

BACKGROUND OF THE INVENTION

Figure 1:
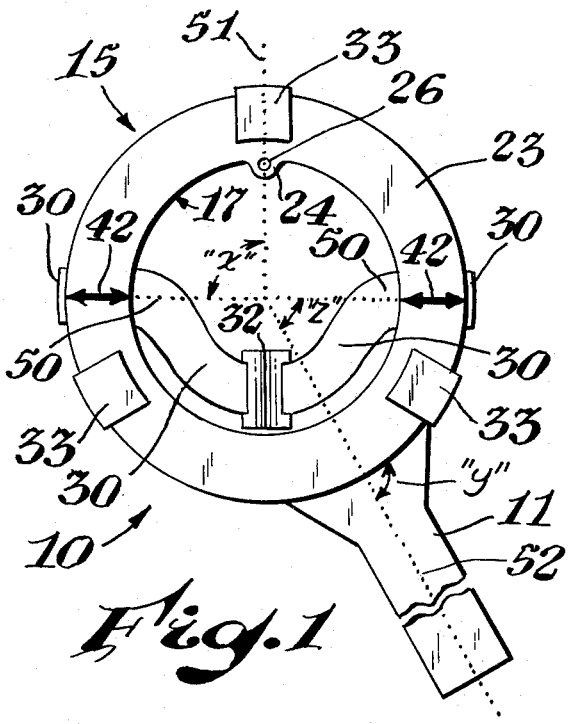

Sling-shots are old and well-known devices for propelling at great speed balls, rock pieces of stones, marbles, capsules, and other suitable missile or projectile weapon objects for hunting, target-shooting and other sportive and still diverse purposes, including, by way of illustration, even message and the like delivery service and so forth. In fact, sling-shots are adapted for employment in combat and have been used as hostile implements of war.

Sling-shots can be simply and relatively crudely made (as from forked tree branches and rubber bands or slit inner tube sections for casting or impelling the missile); or they can be, and indeed are, made in a more sophisticated fashion with precise, patterned designs and structures and well-tailored, quality materials of construction. Of course, the cost of a sling-shot varies with how and from what it is made, as well as its size, power and other intrinsic constructional and manufacturing-requirements features.

Generally, sling-shots are portable devices that are manually used and operated. They ordinarily are provided with a substantially Y-shaped body that is held by the usually downwardly-extending grip or handle portion with the commonly uppermost V-like part of the body having the elastic sling member attached and connected at or near the ends of the usually upwardly-extending forked or bifurcated extensions of the body. Some of the more-advanced sling-shots that are currently available have a more or less U-shaped bifurcated portion of the body attached to or stemming from the handle to the extreme parts of which U-shaped portion are respectively connected the loose ends of the missile-impelling sling.

One of the problems and inconveniences encountered in using conventional and heretofore available sling-shots is the difficulty in easily and readily holding the device for use (at least insofar as the great majority of operators are concerned) to get good accurate sighting — as is generally done upon guaging and target reckoning through the usually upwardly positioned bifurcated part of the sling-shot body — to allow maximum potential for target-finding delivery of the missile upon release of the pulled or stretched-back impelling sling, which is extended for "firing", as it were, of the sling-shot and propulsion (by the quick and forceful snapping or elastic contraction of the sling member) of the missile toward the intended target goal.

The morphology and anatomical characteristics and body-usage traits and limitations of most people are such that when a sling-shot is employed, a right-handed individual extends his left arm to grasp or hold the sling-shot in his left hand to give both greater opportunity for optimum aiming or sighting of the sling-shot and maximum potential for drawing back the sling with the right hand to the furthest-desired or utmost position of extension in order, upon "firing" release of the sling-shot, to power to the greatest possible (or lesser desired) extent the missile that is projected or impelled from the sling into its flight path towards the target. Needless to mention, left-handed individuals employ the exactly contrary procedure.

Now then, most people under the strain of simultaneously cocking the sling-shot by pulling back of the sling member while sighting or aiming the device for missile propulsion opt, and have a pronounced tendency and predeliction, to hold the sling-shot tilted or angulated one way or another out of the vertical and to somewhat correspondingly cock their heads to allow the sighting eye to adjust and get in better alignment with the non-upright device in order to attempt to get a better aim at the target on "firing" release of the implement.

This frequently results in awkward stances and postures during operation. And, in any event, it is not predominantly calculated to achieve and conducive of getting the best sighting and aiming technique and procedure during operation and utilization of the conventional sling-shot. The ability to sight the target with and from the device in a generally or at least substantially (relative to ground level) uprightly or vertically aligned position is ordinarily most advantageous for the purpose, since such position appears best adapted to yield more accurate sighting possibility and generally more truly reliable "firing" propulsions. This is because such vertical position keeps the opposite ends of the sling member in a generally horizontal plane. In this way there is thus less tendency for propelling the missile in more or less specious and relatively unreliable and unsure trajectory in and during its path of flight.

The basic constructional characteristics and operational principles and limitations of conventional sling-shots are so widely comprehended by those skilled in the art (and even others) that further elucidation thereof and elaboration thereon is unnecessary for thorough understanding and recognition of the advance contributed and made possible to achieve by and with accurate and adjustable sling-shot development of the present invention.

FIELD AND OBJECTIVES OF THE INVENTION

The present invention pertains to and resides in the field of an improved sling-shot assembly adapted to well accomodate the most comfortable and natural feeling stance during use of the shooter due to his to her given individual morphological traits and requirements while, regardless of all that, yielding by virtue of adjustment means therein the best possibility of excellent aim of the device without awkward contortion on the part of the user so as to thus tend to ensure consequent optimized target-hitting liklihood potential and capability; the provision of such an advantageous and beneficial sling-shot device having improved, accurate and adjustable means and features for optimum and most successful and satisfactory use characteristics being amongst the principal aims and objectives of the invention.

PARTICULARIZED EXEMPLIFICATION OF THE INVENTION

Figure 2:
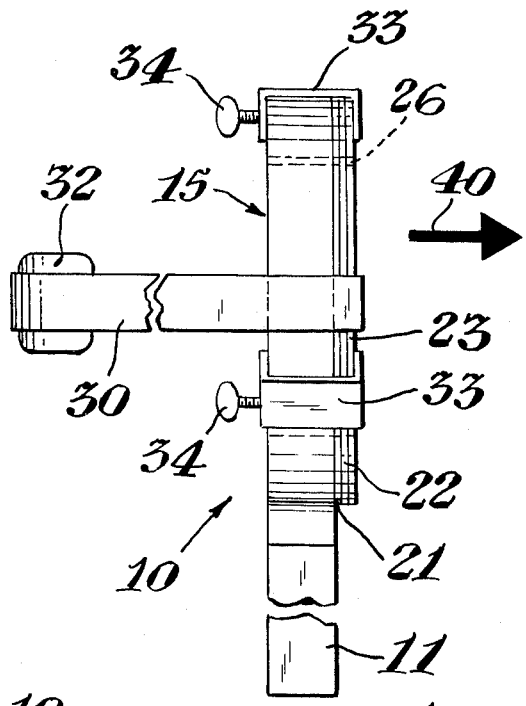

Further features and characteristics of sling-shot devices and assemblies in accordance with the present invention, and their numerous salient benefits and advantages and the way in which they so nicely achieve and fulfill the presently-intended aims and objectives of the invention and contribute to the art for which they are pertinent are more evident and readily apparent in the ensuing Specification and description, taken in conjunction with the accompanying Drawing, wherein (with, insofar as possible, like reference numerals used to identify and refer to like parts or elements):

FIG. 1 is a front elevation of a sling-shot assembly pursuant to the present invention viewed from a position facing and against the line of fire of the device;

FIG. 2, partly fragmented, is a side elevation of the sling-shot of FIG. 1 showing one advantageous means for producing rotatable adjustability in arrangement of the device to ameliorate aiming and sighting control during shooting as well, as is shown in the split-off fragmented portion of the second figure, an optional technique for mounting the missile-bearing pouch on a continuous elastic sling member; and FIGS. 3, 4, 5, 6, and 7, schematically and figuratively, portray advantageous and frequently desirable adaptations and variations possible to embody in assemblies constituted in accordance with the invention.

With initial reference to FIGS. 1 and 2 of the Drawing, an accurate sling-shot that is rotatably adjustable for use and sighting is depicted and generally designated by reference numeral 10. The sling-shot assembly comprises a stem or handle section 11 upon which is secured or mounted a flat cylindrical or ring-like headpiece or circular "tine" which is designated generally by reference numeral 15. The handle or stock 11 may, as desired and physically most comfortable, be thicker or thinner than the headpiece 15 and, if desired, may be rounded (or cylindrical or eliptictical and so forth in cross-section) or otherwise shaped and contoured to give a better finger-and hand-fitting grip. Actually the handle 11 and headpiece 15 combination, per se, may be and often desirably and advantageously is a one-piece moulded, cast or otherwise fabricated unit or construction.

The handle 11 and circular headpiece 15 is of any desired and suitable material of construction. They may be cut, cast, molded, or otherwise fabricated into their constructed integral or separate piece form(s). Metal, such as steel or other ferrous alloys (which can be plated for appearance and/or protection), aluminum and so forth, is generally quite good for the construction; although excellent devices can be made from various plastic (particularly impact grade) materials, wood (laminated or solid), concrete (reinforced or not) and other strong and sturdy materials of construction possible to fabricate into the appropriate shaped form.

There is an internal (ordinarily best uniform) opening or aperture, generally designated by reference numeral 17, centrally formed in the headpiece 15. The dimensions of the remaining ring formed as the headpiece with aperture 17 therein, as is obvious, depends on the strength of the materials of which the sling-shot is made taking into account the particular size and involved design of a given assembly and the tractive-effort or pulling-force necessary to cock or ready the sling-shot for "firing" (the calculations of these particulars being, as is also apparent, readily performable by any person skilled in the art). Usually, however, the handle 11 is long enough to allow for a full and complete full hand grasp thereof, with oftentimes a few inches or so extra being allowed to permit that plus leaving a spaced interval above the grasping area to the juncture of the handle stem and at its point of connection with the circular "tine" or headpiece 17. The aperture 17 should normally be of a minimum diameter of 2 to 2½ or so inches with not too much advantage for normal purposes being realized with contraptions having more than about 12 inch openings; although for most applications and purposes it is desirable and very appropriate for the headpiece to have an opening with a diameter of between about 3 and about 6 inches. Ring wall thickness and depth dimensions, as is the case with the handle, are easily calculable for given materials of construction of the sling-shot taking its power and strength requirements into account.

FIG. 2 illustrates with some particularity a sort of rotatable adjusting means assembly that can advantageously be employed in sling-shots made in accordance with practice of the present invention (with the frontal face view of this discernible in FIG. 1). An outer washer-like sling-fastening and holding ring 23 is positioned over and on a central (and optionally employed) washer-like gasket or filler and spacer ring 22 which seats on an innermost primary band or ring 21 located against the outer face of the cylindrical headpiece 15. The rings 21, 22 and 23 are generally of about the same inner and outer diameters. Although not necessarily so dimensioned, the innermost and outermost rings 21 and 23 can most often and conveniently have about the same flat thickness.

The spacer ring 22 can be a one-piece unit. It may also, if desired and oftentimes with considerable advantage, be a split ring or one provided with peripheral indents or cut-outs at the diametrically opposed areas where the disconnected ends of the sling band(s) 30 are received and engaged in the assembly. Although such a sling-band accomodating fabricated form of the spacer ring or washer 22 is not depicted in the Drawing, it is readily comprehensible to and easily embodied by the artisan for refined practice of the present invention. As is apparent, such forms of the spacer ring 22 can well facilitate better reception and more convenient, secure and precise positioning and holding of the disconnected ends of the rubber or other frequently flat elastic band or strip designated by reference numeral 30 in the Drawing to represent the sling band(s) attached in and to sling-shot assembly 10.

The band 30 can be of any suitable and sufficiently strong and snappably reactive elastomeric material to give proper and forceful enough sling-impelling action when released from an extended position after being cocked (i.e., in effect simply pulled back) for "firing" of the sling-shot. As a practical matter, even the well known and frequently heretofore utilized split or sliced inner tube-type (cut from the inflatable tubes widely employed for vehicular tires and the like) may be very satisfactorily employed as the sling band(s) 30. Of course, special constructions and materials may also and frequently with great advantage be utilized for the purpose including, by way of illustration, specially-made flat band stock, elastomeric tubing or other hollow or solid cross-sectioned fabrications which can be of square or other polygonal outline additional to rectangular, circular or otherwise configured cross-sectional patterns and so forth. It is possible and sometimes quite desirable, in fact, to use coil spring elements and the like or equivalent stock for the purpose of providing the sling band(s) 30.

The spacer ring or washer-like gasket 22 is best somewhat thinner than the thickness of the sling band(s) 30 so that, with compressive structure of the mounted rings 21, 22 and 23 on the headpiece or frame head 15, on the making of such compressive assembly of the rings with the sling band ends in place there is very effective and efficient mechanical squeezing and holding action achieved upon the ends of the sling band(s) 30 between rings 21 and 23 so that very secure fixing in place is made in the assembly overall.

The spacer ring 22 may be of any desired solid or rubbery or even other material of construction. Thus it may be metallic (including lead or the like composition of relatively compressable metals or metals formulations), wood, rubber or other elastomer or plastic, cork, asbestos and so forth. It is sometimes desirable for spacer ring compositions to be of a fiber or other filler reinforced sort of composition or, as an oftentimes advantageous alternative, or an actually fibrous or cloth-like material or even a fabric which may be of a woven or non-woven construction. This includes, for example, even knit goods and such things as felt and felt-like materials, looped, tufted, pile and other carpet-like fabrications and the "toothed" and so-called "soft" cloth types oftentimes used and found in outdoor and military gear and garments. Laminate constructions of diverse materials may be employed for the spacer ring 22. In addition and many times with significant benefit, the spacer ring may be provided with comprised of an adhesive surface of contact (provided either on its own flat surface and/or on either or both adjoining contact surfaces of rings 21 and/or 23) to aid in and facilitate the quicker and more accurate and easy setting and re-setting of the mounted rings assembly with the sling band in place. The "dry", non-permanent-bonding contact and pressure adhesives and/or cements readily available in the market are very good for this purpose; these being well adapted to be painted or otherwise coated or deposited on all or any desired portion or spot of the contacting surface(s) on or between one or more of the rings 21, 22 and 23. It is even possible, however, to employ an adhesive agent for the indicated purpose that is of a relatively "tacky" or non-dry characteristic and nature.

A plurality of clamps 33, advantageously of the C-clamp style, with turnable set-screws 34 provided therein may be employed to hold and fix the rings 21, 22 and 23 in desired relative position with and between one another and against and upon the outward (or other) mounting face of frame head or headpiece 15 so that there is snug, firm, strong and positively fixed engagement overall therebetween. These clamps 34 are loosened for rotation of the rings 21 and/or 22 and/or 23 and tightened for ring securement and locking in place. One or both of the legs of the clamps may, if desired and as is easy to visualize despite the fact that it is not shown in the Drawing, be turned inwardly at the end to fit loosely in accomodating slots, grooves or other receiving apertures in the side faces of the headpiece 15 in order to add some better degree of permanence to their association in and placement with the device, with minimized change of loss or unwanted detachment from the assembly being thereby involved when the sling-shot is being handled, used or stored.

Circumferentially wide clamps or the like brackets may be utilized if relatively thinner or narrower ones are not preferred in any given instance. These may have radian or other more or less circular subtentions, as desired, although unless specially designed broad clamp brackets of more than semi-circular span may sometimes be awkward to utilize. In any event, such broader clamping means oftentimes give greater firmness to the mounted ring(s) in assembly on the headpiece, with minimized number of clamp implements being thereby necessary.

Usually, at least two and, preferably, three clamps or the like set about at more or less equispaced points around the headpiece 15 are employed. This is especially so when the more commonly utilized relatively narrow clamp means is involved. Of course, a greater number of clamps or other ring-locking or -fixing inplements can be used. In this connection, it is not always disadvantageous or whatsoever impossible to assemble a quite satisfactorily operable sling-shot pursuant to practice of the present invention with only a single ring-holding unit being provided therein; this being especially the case when the sort of relatively circumferentially wide and more or less greater peripheral segment spanning clamps or brackets of the variety mentioned in the foregoing are used.

As has been indicated and as is obvious enough, other types of clamp provisions besides those particularly above described can be equivalently and quite satisfactorily employed to secure the rings in adjustably rotatable or otherwise movable disposition on the headpiece. To more particularly albeit without limiting intent illustrate this (taking into account that no depiction of same is made or given in the Drawing), it is nicely possible to employ bayonet-type or analogous and similarly-conceived and embodied interconnections between ring(s) and headpiece to alternatively make the mounting while retaining excellent characteristics of adjustability and secure placement. In these, although they are generally on one or more of the rings, the male elements of the fastening means may also be made to emanate from the face of the headpiece. When a bayonet inserting arrangement is used with the female accomodations therefor in the face of the headpiece, the male parts are usually on the outermost ring when a plurality of rings is involved with accomodating openings for bayonet element passage in the inner ring or rings. Somewhat likewise and in fact, the rings may be circumferentially provided with a suitable plurality of corresponding matched or mating holes, slots or other openings through which screws or other connecting means can be inserted to be tightened down for ring holding in appropriate tapped or otherwise appropriately accomodating engagable openings disposed in plural number in the face of the headpiece. Either of these ring-clamping variations (or even other analogies thereto such as insertable snap fittings and/or turn-locking alternatives to bayonet inserts) are adaptable to good adjustability of the ring(s).

Along this line and as is readily appreciable, the greater the number of circumferentially disposed connecting points provided between headpiece face and ring(s) mounted thereon the greater is the flexibility and precision to finer adjustment possible in the relative rotational setting of the ring(s) on the head frame in the ready-to-use assembly. In any event, at least approximate, usually quite closely approximate, rotational positioning of the ring(s) is thus afforded. As is readily evident and easily reckonable and providable, the vernier capability of such ring mounting techniques depends on the cooperative plurality of engagement or connecting points involved in the set-up and the effective spacing(s) thereof; the desired fineness in the end result being increasingly facilitated with increasing plurality of such points.

Needless to emphasize, clamp arrangents of the C-clamp or equivalent or like style and sort which offer and involve no physical rotational stop or other impediment to ring adjustment give literally infinite rotational setting possibilities for the ring(s) mounted and positioned in the assembly.

With further reference to this, still other clamp means and instalments like or equivalent to C-clamps for securing the rotatable rings to the headpiece may also and yet alternatively be utilized. Thus, extending brackets permanently affixed to the headpiece (or, contrarily, to one or more of the rings) with set-screw or other provisions for holding in place the properly positioned rings may similarly be employed with good result.

While three rotatable rings are shown on the forward or outer face of the headpiece (i.e., the frontal portion of the headpiece in the direction of the target which is indicated by arrow 40), less than this number can be employed. For example only two band-securing rotatable rings can be utilized with the ends of the band held securely between them by any suitable means or accomodations for compressive or other mechanical securement. For that matter (although it facilitates easiest replacement, etc.) the ends of the sling band 30 or the like can be held on the rotatable ring(s) by other than sheer physical compressive or squeezing effect or influence. Thus, they may be glued or welded or otherwise bonded or sealed in place or held by mechanical fasteners of any suitable and desired sort, such as clamps, screws, pins, pegs, puncture catches and so forth. When fastening of the sling band is accomplished by positive (other than ring-squeezing) mechanical means, it is oftentimes entirely satisfactory and even then advantageous to have and employ only a single, rotatably adjustable band-fastening and -bearing ring in the sling-shot appliance pursuant to the present invention.

Figure 3:
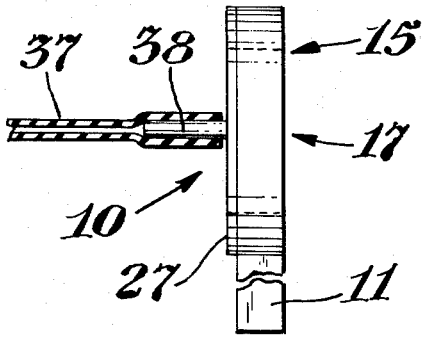

Furthermore, the rings need not be adjustably held on the forward face of the headpiece, especially when varying band or sling-impeller types and fastenings to the ring are utilized. This, for example, is schematically illustrated in FIG. 3 wherein each of the ends of the sling band 37 is an extensible rubber (or like or equivalent) tube or hose which is merely forced over for tightly-held expansion fitting on a supporting, adequately long (an inch or two being usually enough) peg mount or strip 38 attached, to project backwardly from target direction, on the rearward side of single adjustable ring 27. With such a tubular band 37, the extending and elongating pull effort necessary to cock the sling-shot for "firing" contracts the tube 37 and makes it very tenaciously bite or grip the usually stud-like mounting peg 38 (which has a practical and effective for the purpose greater diameter than the inner diameter of the tube). This action perforce and inherently adapts the tube to resist and prevent its being pulled off during band extension in the cocking action of the sling-shot. If desired, the peg mounts 38 may have a roughened surface to help hold the tubular band 37 in position thereon; or adhesives may also be used to strengthen such a mounting (although this is not a usual necessity). Of course, multiple adjustable ring arrangements may also, if desired, be situate on the rearward face of the cylindrical headpiece; and good results are likewise obtainable in such an assembly wherein any suitable means of sling band securement may be utilized.

In this connection, the peripheral edges, as well as all of the face area, of the headpiece need not be sharply cornered and flat. Rounded or tapered edges may be used and, for that matter, contoured and cross-sectionally rounded or otherwise out of square faces may be present in the headpiece, although it is generally beneficial for at least a substantial portion of the headpiece face on which the rotatably adjustable ring is positioned to be flat for better and more positive bearing and seating of the ring(s).

Also, it is usually for best and easiest complete and most accurate alignment and setting of the sling-shot to have the inner diameter of the ring(s) employed to be about the same as the diameter of the opening 17 in headpiece 15, although in some cases it may be suitable to have one or more rings with smaller diameter(s) than that of the opening; this practice being more tolerable and acceptable if at least the innermost ring (when more than one is used) is provided with an inwardly projecting circumferential flange or projection (or even interupted guide extensions) to fit within and more or less against the cylindrical wall of the opening 17.

Ring thickness can vary, as desired; although spacer rings or gaskets 22 should obviously be thinner than the thickness of a flat sling band being used when the band is compressively held in grip of the inner and outer rings in a three-ring set-up. Usually, rings from 1/16 to ⅛ or even ¼ of an inch are satisfactory, although there is no limitation in this. Besides the various materials mentioned above, rings of the materials as described for the body of the sling-shot can also be suitably employed.

Although not absolutely necessary for satisfactory results, it is ordinarily most desirable and highly advantageous for a sight means to be incorporated in or with one of the adjustable, sling band-bearing rings in the assembly; this when more than a single ring is utilized, being preferably the outermost ring or at least the one to which the band ends are affixed. The sight means may be an inwardly extending pin or V-projection or a cross-bar type appendage or other bump or depending projection placed on the ring so as to be at any desired and most individually attractive angular displacement on the inner circumference of the ring from the geometric mid-point of band attachment to (or, if other associations are involved, relationship with) the ring. Ordinarily, however, about a 90° displacement is employed. When the inner diameter of the ring or rings employed is less than the diameter of the opening in the headpiece, a good sight or aiming assistant may be a simple V-notch or groove cut in the ring(s) at the 90° or other selected displacement from the point of band end fastening. In any event, it is most desirable to have the sight assisting means on the normally upper portion of the ring with respect to ground; and they also may be provided in individual rotatably adjustable mountings to best accommodate individual preferences for sight position in the sling-shot assembly.

One very advantageous and generally quite reliable sight assisting means to utilize is directly illustrated in FIGS. 1 and 2 of the Drawing. This is a construction that forms or provides an inwardly-extending projection or appendage 24 on one or more of the rings. Appendage 24 thus drops inwardly into and over and through the circumference towards the center of the opening 17. A sight hole 26 is provided centrally in the depending appendage 24. As is the case with any sight — or aim-assisting contrivance employed in the sling-shot, looking to the target through the hole 26 (or with guidance from other sighting means) while the bands are extended more or less, if not precisely, parallel with the ground with the sighting eye advantageously over the cocked sling bands (or the like) about, if not exactly, at the same effective viewing spacing as that between hole 26 (or other sight means) gives a very good and accurate targeting capability of the sling-shot. Of course, as with any other missile-projecting implement, the good and usually successful shooter makes allowances (usually gained with practice and calculable from experience) for proper trajectory to achieve in order, especially with more distant targets, to take into account gravitational effects on the projected missile — which is all a matter of ranging — as well as proper lead to allow for and get effective hitting of moving targets — which correlates missile speed with target speed.

While quite easily apparent from comprehension of ordinary sling-shots and observation of FIGS. 1 and 2 of the Drawing, the pouch 32 which contains the missile to be propelled (not shown) may be fixed at the center of the unsecured end (or ends) of the sling-band (or the like) 30 in any desired way. For example, as portrayed in FIG. 1, the ends of sling band 30 not fastened to the ring(s) on the headpiece 15 may be independently disconnected and sewn, stapled or otherwise suitably fixed to the forward side ends or edges of the pouch 32 (which may have any desired form or configuration). Or, as depicted in the fragmented part of FIG. 2, the sling band 30 may be continuous between fastened ends with the pouch 32 mounted centrally thereon either inside (as shown) or outside the band. Any satisfactory pouch type or arrangement may be used.

Reverting again now to FIG. 1 of the Drawing, the rotatable and pragmatically efficient angulation adjustment features and characteristics of sling-shots in accordance with the present invention are also evident. While not absolutely necessary to utilize, it is oftentimes very beneficial to have band centering marks or inscriptions, such as the arrows 42 or equivalent pointers, on the outside face of the outermost ring utilized in the assembly. This helps assure the very precise and diametrically or segmentally less accurately opposed securement of the sling band ends on the rotatably adjustable ring or rings. The inner diameter of the adjustable ring 23 (which is aligned exactly and/or concentrically with the same or greater diameter opening 17) is illustrated by the dotted line designated by reference numeral 50.

Although lower, semi-circular or equivalent subtending positioning is obviously possible and in some instances may even be preferred, the sling bands should ordinarily be centrally fixed tangentially at the diametric crossing of line 50 with the sight-assisting means, such as sight hole 51, being along a line (indicated by the dotted line identified with reference numeral 51) which lies normally or at right angles to diameter line 50, as illustrated by the 90° angle called "x". The dotted line, marked by reference numeral 52, extends downwardly parallel on or along the central axis of the handle or stem 11 after emanating from the intersection of lines 50 and 51. It thus forms a right angle (shown as 90° angle "y") with any circumferential tangent line (not shown) of the ring 23 and/or opening 17. When the sling-shot 10 is held with the handle 11 perfectly upright, the dotted line 52 is vertical and disposed in perfectly normal situation relative to level ground.

The angle identified as "z", which is generally acute and never greater than at a right angulation, defines the tilt, if any, from vertical (and in either direction) that the handle and entire body of the sling-shot is displaced from the vertically straight and upright position when held by a shooter in the most comfortable and natural — or otherwise preferred — position appropos for him (or her). In the depiction of FIG. 1, there is presumed sling-shot usage by a right handed shooter who tilts the sling-shot angularly so that its uppermost portion inclines away from the bottom of the handle (considered as a pivot point) to the left and inwardly towards the body; this being when the sling-shot is held, in and with the hand of the outstretched left arm. This is most likely to be particularly so with the sling band pulled back to set the sling-shot in cocked position for aiming. Obviously, however, another given individual may well tilt the sling-shot into an opposite inclination from the vertical. And, some shooters (although it is rare) may actually hold and use the sling-shot in an at least essentially perfectly upright and vertical disposition. In any event, angle "z" demarks the degree of tilt effected by the user. Angle "z" also, as is apparent, delineates the consequent displacement necessary of the diametric line 50 (at the extremities of which the sling bands are fastened to the rotatable ring(s)) to get line 51 in vertical disposition in order to have the sling-bands advantageously aligned and disposed generally in a plane parallel with level ground and the uppermost sight guide situate 90° vertically upwards from this plane with line 50 then in the mentioned preferred vertical disposition instead of handle line 52. This avoids the disadvantages of, and sighting and shooting innacuracies caused by, having the sling bands situate and disposed in an inclined diametrical plane with a then unavoidable offset and angled location of the guide means relative to a vertical line passing centrally through the headpiece during operation and "firing" of the sling-shot.

As should appear and be readily evident in and from the foregoing, adjustment of a sling-shot assembly made pursuant to the present invention to customize it to any given shooter's particular needs in order to give optimum sighting and most accurate and determinable-as-intended "firing" and target-hitting and scoring capabilities is quite simply and readily made and achieved. The user, preferably (yet not mandatorily so) by actual trial, determines which position of tilt angulation (if any) is desired or necessary for him or her to have the best feel of and with and holding position for the sling-shot being employed. Given that, the rotatably adjustable sling band (or the like) bearing rings are moved and set fixedly in place so that the sling band is disposed and operable upon cocking and firing in a general plane at least approximately parallel with level ground and the sighting means (as are most advantageously incorporated in the assembly) are positioned more or less in or along a line running at least about 90°, if not precisely at a right angle and perfectly normal, with respect to said plane, preferably at or towards the upper periphery of the opening in the headpiece or circular "tine" in the vertical line passing centrally through the opening. Of course, it may be required or desired to make more than a single, increasingly finer adjustment to get as near perfect an arrangement setting in the finally calibrated sling-shot as can, for at least practical purposes, be gotten.

The pre-set sling-shot is then ready for very good and effective use by the person for whom it has been calibrated and and adjusted. It goes without saying that customization of a sling-shot already set for one individual may — and generally does — necessitate re-adjustment if another shooter intends to use the same sling-shot; this being, as can be readily appreciated, no great problem.

Figure 4:
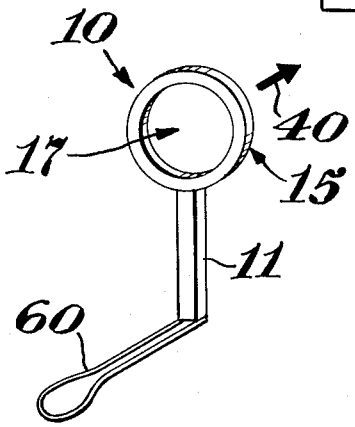

In FIG. 4, a stripped-down sling-shot made according to the present invention is depicted having a very beneficial attachment thereon and integral therewith. This is a wrist support element 60 which helps steady the sling-shot during cocking and "firing" and assist in its better and more accurate alignment and most desirable positioning during use. The wrist support 60 is generally fixed at or near the bottom of the handle 11 and extends to the rear of the sling-shot 10 towards the body of the user when the assembly is held for use.

The wrist support 60 is usually a more or less "pear-shaped" loop or bracket (of suitable tubing or cylinder stock or the like or equivalent material, preferably at least fairly rigid and sturdy as is usually the case when it is made from metal stock). It is mounted so as to extend disposed in a plane that is about, if not exactly, perpendicular to and with the line 52 (not illustrated in FIG. 4) which is parallel to the general central axis of handle 11. Naturally, custom-fitted deviations from this general pattern may be worked into the wrist support.

As it fits on and against the user, the outer edge or portion of (usually) at least the base of the palm and the relative analogous side of the wrist fit into the narrow part of the wrist support 60, with the enlarged end loop thereon going against the edge of the forearm and extending therealong at some mid-point between elbow and wrist. Especially when the hand is held on the grip as close as possible towards its bottom end and snugly against the wrist support, a very firm and more or less locking engagement and holding of the sling-shot is possibilitated. This frequently lends materially to the aiming precision that may be achieved with the sling-shot. Other equivalent and comparable wrist-supporting means and sling-shot steadiers may be utilized in combination with the assemblies in accordance with the present invention. These may include, by way of example, one or a disconnected plurality of straight or configured rod(s) or bar(s) extending perpendicularly from the bottom part of the handle which also, if desired, may have straps or ties to secure the gripped sling-shot firmly in place with the support thus positively engaged with and against the wrist and/or forearm of the user.

Figure 5:
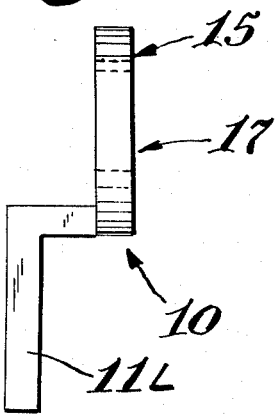
Figure 6:
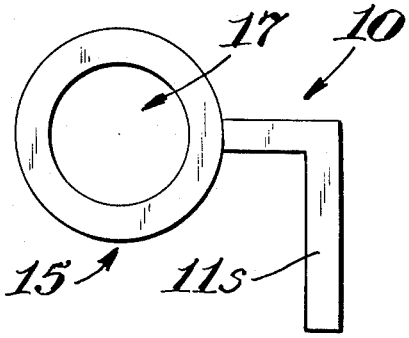

FIGS. 5 and 6 very schematically show diverse offset handle arrangements that may be utilized in and for sling-shots fashioned in accordance with the present invention. These are oftentimes useful and beneficial to avoid impingement and smacking or slapping of the impelling sling band (or the like) after "firing" upon and against the holding hand of the user. The offset handles 11L and 11S in FIGS. 5 and 6, respectively, accomplish this by more or less displacing the headpiece 15 from immediate vicinal proximity to the grasping hand of the user which is holding the sling-shot. Chances of hitting the hand with the contracting, rapidly moving sling band or pouch are thus beneficially minimized if not completely avoided. In this connection, it should be taken into account that the torque effects created when offset handles are employed (including even some of the variations described in the following in association with FIG. 7), especially when lateral offsets are involved, may be of sufficient magnitude to dictate preferred use then of a wrist support attachment in the assembly to thus avoid disadvantages possible to encounter for the indicated reason.

FIG. 5 shows an inverted L-shaped handle 11L for such purpose as is immediately above described and indicated. Handle 11L is set parallel with line of missile flight and disposes to the back side of the sling-shot 10 with the depending, downwardly-extending grip part of the handle offset and spaced back from headpiece 15. In this way, the finally returned and contracted and expended sling band has a greatly diminished, if not entirely eliminated, opportunity to hit the shooter's hand after completion of the missile-hurling operation.

Although not illustrated in the Drawing, a satisfactory result can also be provided for and achieved by placing the offset handle 11L of the overall style shown in FIG. 5 in the same line-of-flight parallel plane but extending oppositely in the direction away from and forward of the face of the headpiece 15.

An also generally equivalent laterally offset handle can be fabricated and provided to extend first outwardly (from either desired side of the headpiece, although to the right for a right-handed shooter is probably better generally for a person so oriented — with the obverse holding true for left-handed individuals), then downwardly (for the grip part of the handle); with all of this being at least roughly if not exactly in a plane the same as or closely parallel with the generally flat plane of and in which the circular headpiece (or "tine", as it were) is disposed. Handle 11S in FIG. 6 depicts such a laterally-extending offset stock or stem on a sling-shot in accordance with the present invention. Any desired offset distance can be used in and for handles such as 11L (shown in and previously described for FIG. 5) and 11S in FIG. 6. In the usual instance, however, an offset of between about 2 to 4 inches or so is quite satisfactory and well proportioned and calculated to effectuate the indicated result.

Figure 7:
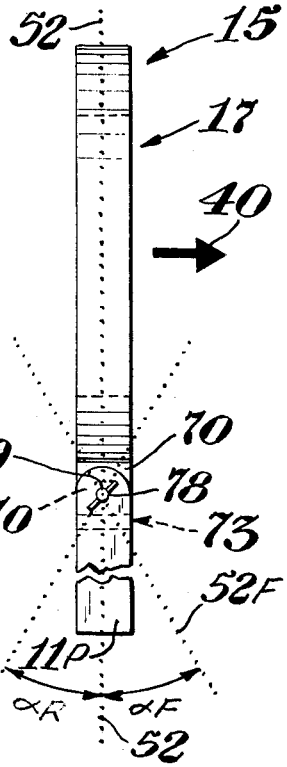

Going now to FIG. 7, a frequently most desired and a beneficial to utilize optional feature in sling-shot assemblies made in accordance with present practice and concept is again schematically and figuratively depicted and set forth. This is an adjustable handle (or grip or stem or stock) portion in the body of the sling-shot; the handle being provided and adapted to be pivotable at or near its juncture with the head frame or headpiece portion 15 of the sling shot assembly 10. Such an advantageous handle unit is designated with reference numeral 11P in FIG. 7. Most often, it is pivotable or tiltable one way or the other with respect to the line of direction of "fire", indicated by arrow 40, of the sling-shot — this quite frequently being restricted to parallel "back-and/or-forth" moveability.

One quite handy and simple way of achieving such an arrangement for handle tilting or pivoting in line-of-"fire" direction of the sling-shot is to groove, notch or otherwise cut out the upper end of the handle 11P to give it a slot opening 73 which loosely, or at least moveably and unrestrictedly, fits about the abbreviated — at least in the ordinary case — shank 70 by and upon which the handle 11P is then held with and to that depending piece or part of the headpiece 15 beneath the opening 17. Tightening of a handle 11P so-arranged to set it in place with any desired angulation relative to the ordinarily upright plane of the headpiece may be accomplished in any of a number of suitable and satisfactory ways and means of mechanical adaptation for the purpose. For example and as shown, a wing-nut or the like 78 threaded on a screw element 79 provided and fed through an opening (not shown) appropriately made in and extending through the upper part of handle 11P at its notched fork section and shank 70 may be utilized.

In any event, movement of the handle back and forth through the angle $\alpha R$ (i.e., "alpha" R) or $\alpha F$, respectively designated as measuring and describing the angulations between the normally vertical center line 52 for an untilted handle or at least through the upright lateral plane of headpiece 15 (said center line 52 being shown in dotted representation), and the also-depicted-in-dotted-outline lines 52R and 52F, generally quite definitely tends to give for the shooter a further enhanced and more comfortable, convenient and "natural"-feeling holding position of and for the sling-shot in order to yet better and still more advantageously accomodate and conform to and allow for and blend-in with wrist and- /or hand positioning and other body structure and/or shooting style of the user; all this adding further to better results with the sling-shot assemblies possible to embody with such further beneficial feature in accordance with the present invention. Of course, other handle mounts, such as ball-and-socket units, swivels, rotatable union-joint fastenings and so forth can also be employed for purposes directly associated with or in still additional refinement of the variation illustrated in FIG. 7. These, if desired and with not infrequent or uncommon added and yet incremental advantage, provide for lateral pivot or tilt of the handle 11P relative to headpiece 15 separate from or additional to simple "back-and-forth" pivoting movement; lateral and/or combined pivoting or tilting being, as is easily appreciable, possible and sometimes desirable in literally any wanted azimuthal or arced relationship as may be taken from above the assembly looking down over the vertical center line (with respect to level ground) of the apparatus.

Many changes and modifications can be readily made and provided in various adaptations and embodiments in accordance with the present invention without substantially departing from the apparent and intended spirit and scope of same relevant to the instantly contemplated and revealed accurate and adjustable sling-shot development and provision.

Thus, as particularized illustration and substantiation of this:

i. the headpiece and/or handle portions of the sling-shot body may be partly or entirely of tube stock material;

ii. the headpiece may comprise an interrupted or split cylinder, especially at its upper configuration; or iii. the frame head need not be exactly cylindrical in shape but can be more or less out of round;

iv. the adjusting ring elements whether cylindrical or otherwise in nature can even be also utilized on and with more or less standard and at least approximately conventional Y-shaped or U-shaped body members; and even further v. the adjusting ring elements, per se, need not be circular but can assume other than circular and even polygonal configurations and also need not be full rings or the like or equivalent but can be split or open, generally arcuate forms or collar members just so long as enough of an uninterrupted circumferential or peripheral body is contained therein to allow for good sling band securement and support and adequate mounting on the head frame.

Accordingly, the invention and all in pursuance and accordance with same is to be taken and liberally-constructed as it is set forth and defined in the hereto-appended claims.

What is claimed is:

1. In a sling-shot assembly having a frame head portion with a handle portion depending therefrom to which frame head portion there is attached an aligned extensible elastic sling band for generally non-elongate missile hurling without physical missile guide means thereabout which extensible sling band is securely attached by the disconnected ends of said sling band at spaced points on and to the frame head portion of the body of the sling-shot that is over it's handle portion:

means rotatable in a substantially vertical plane in combination in said sling-shot for adjusting the points at which said disconnected ends of said sling band are secured and fixed to said frame head so that, during operational usage of the sling-shot disposed in given situation according to the mode of grasp and stance employed by the user, the said points are disposed and situate relative to one another and to level ground in a plane that is at least substantially parallel to and with the plane of the level ground.

2. In the assembly of claim 1, wherein said adjusting means are rotatably adjustable on and in the same plane of said frame head portion.

3. Sling-shot comprising, in cooperative assembly:

a body unit having a generally circular and flatly cylindrical frame head portion with mounting faces on each side thereof which is supermounted over and joined with an extending handle grip portion said frame head portion being so configured as to form within its confines an at least substantially round opening in said frame head which opening gives free passage of missiles hurled out of and propelled for flight from the sling-shot by the provision of extensible, elastic sling-band means in the sling-shot, said elastic sling-band means mounted in said sling-shot;

at least a single generally washer-like sling band bearing ring positioned in fixable but rotatably movable engagement having faces on each side thereof with one of its faces on and against one of the mounting faces of said cylindrical framehead, the inner diameter of each of said rings having at least approximately the diameter of said opening in the frame head;

each of said rings being concentrically positioned in the assembly with respect to said opening;

the respective disconnected ends of said sling-band means being mounted upon and securely attached to and with at least one of said rings at at least approximately diametrically opposed points of securement for said ends on the peripheral area of each of the rings;

means for locking each of said rings in predetermined relative disposition placement on the face of said frame head on which each ring mounting is made; and means for loosening each of the ring in the mounting on the face of the frame head portion to permit rotational movement thereof; whereby and whereupon adjustment of the diametrically opposed points of securement of said sling band on and with each and every of said rings may be made so that said points are then rotatably movable to another disposition wherein they are then disposed if not so positioned so as to generally lie in any plane relative to the general center line of the handle portion of said sling-shot including that plane, during operational usage of the sling-shot, which is at least substantially parallel with the plane of level ground.

4. A sling-shot according to claim 3, wherein each and every of the sling band bearing rings is mounted on the face of said frame head portion forwardly in the direction of the target relative to the sling-shot.

5. A sling-shot according to claim 3, wherein there are a plurality of said sling band bearing rings in the assembly and the disconnected ends of said sling band means are mounted on said bearing rings by compressive securement between the rings.

6. A sling-shot assembly according to the assembly of claim 5, wherein there is an adhesive deposit on at least one of the faces of the central, spacing sling band bearing ring.

7. The sling-shot of claim 3, containing three of said sling band bearing rings, one of said bearing rings being innermost to and against the mounting face of said frame head portion, another of said bearing rings being outermost and away from the mounting face of said frame head portion, with said sling band means being a flat elastic member thicker than the central sling band said sling band means having its disconnected ends inserted between the innermost and outermost bearing rings for compressive mounting there between and with the band bearing rings.

8. A sling-band assembly in accordance with the sling-band assembly of claim 7, wherein there is an adhesive deposit on at least one of the faces of the central, spacing sling band bearing ring in the assembly.

9. The sling-band assembly of claim 8, wherein said adhesive deposit is a "tacky" adhesive deposit.

10. The sling-shot of claim 7, wherein said central sling band means bearing ring is thinner than the adjacent innermost and outermost sling band bearing rings mounted on the head frame portion.

11. The sling-shot of claim 7, wherein said central sling band bearing ring has accommodating peripheral openings therein which are adapted to receive the disconnected ends of said sling-band portion.

12. The sling-shot of claim 7, wherein said central sling band means bearing ring is of a fabric-like material of construction.

13. A sling-shot according to the sling-shot of claim 3, wherein there is a single sling band bearing ring mounted on the face of said frame head portion rearwardly away from the direction of the target relative to the sling-shot; and said sling band portion is an elastic tube; with a pair of mounting pegs provided on the flat rearward surface of said sling band bearing ring which are positioned diametrically across from one another and project rearwardly from the ring;

the diameter of said pegs being greater than the inner diameter of the tubular sling band and forcible within the open ends of the tube when the sling band means is not extended;

said tubular sling band being mounted on said bearing ring by having its disconnected ends expandingly force fit respectively over said mounting pegs.

14. A sling-shot in accordance with the sling-shot of claim 3 and containing, in addition thereto and in combination therewith, a means for assisting aiming and sighting of the sling-shot on at least one of said sling band means bearing rings disposed and located thereon at a fixed peripheral location relative to the diametrically opposed points of securement for the disconnected said sling band means on and with each of said rings.

15. A sling-shot in accordance with the sling-shot of claim 14, wherein the sight assisting means is disposed on only a single sling band bearing ring and located thereon so as to be situate about 90° C in a direction away from the handle portion of the assembly.

16. A sling-shot assembly according to claim 15, wherein the sight assisting means is a projection with a sight hole therein that demands and projects inwardly from the inner circumference of said ring.

17. The sling-shot of claim 3, wherein said means for locking and loosening each and every of the said rings in their mounting on the face of the frame head portion are C-clamp-like units adapted when tightened to engage and secure each of said rings upon and against the supporting frame head face on which each and every of the rings are mounted.

18. A handle grip portion in a sling-shot according to claim 17, which handle is offset to the rearward face of the frame head in a direction away from the target relative to the sling-shot.

19. The sling-shot of claim 3 and having, in addition thereto and in combination therewith, a wrist support member fixed to and extending from the handle portion of said sling-shot.

20. The sling-shot of claim 3, wherein said handle grip portion is provided in an offset form whereby the handle grip portion thereof depends from the frame head portion along a line spaced apart from the center line of and within the frame head that is parallel to ground.

21. A handle grip portion in a sling-shot according to claim 20, which handle is laterally offset from said frame head.

22. The sling-shot of claim 3, wherein said handle grip portion is pivotally mounted therein so as to be disposable to and in a fixed position at an angle out of the normally vertical upright center line which passes through the middle of the frame head portion of the sling-shot assembly.

23. A sling-shot in accordance with the sling-shot of claim 22, wherein said handle grip portion is a pivotable handle having the pivoting mounting means therefor which mounting means joins said handle to said frame head portion at a juncture point near the joinder of said frame head portion and said handle.

24. The sling-shot of claim 23, wherein said pivotable handle grip portion is so pivoted as to be angulatably disposable in either direction back-and-forth and forwards-and-backwards with respect to the line of "firing" direction of the sling-shot.

25. The sling-shot of claim 24, wherein said pivotable handle grip portion is essentially limited to backward-only pivoting movement.

26. A sling-shot according to claim 23, wherein said pivotable handle grip portion is pivoted so as to be angulatably disposable in a laterally inclined direction with respect to the line of "firing" direction of the sling-shot.

27. The sling-shot of claim 22, wherein said pivotable handle grip portion is completely swivellable so as to be disposable at any angle through 360° about and with respect to the normally vertical upright center line which passes through the middle of the frame head portion of said assembly.

28. The sling-shot assembly of claim 3, wherein there is an adhesive deposit on at least one of the faces of at least one of said washer-like sling band bearing rings.

29. The sling-shot of claim 3, wherein said means for locking and loosening each of the said rings in their mounting on the mounting face of the frame head portion is a single, circumferentially wide bracket-clamp unit adapted when tightened to engage and secure each and every of said rings upon and against the supporting frame head portion face on which each of the rings are mounted.

30. The sling-shot of claim 3, wherein said means for locking and loosening each and every of the said rings in their mounting on the mounting face of the frame head portion are bayonet-insert-type connections between said rings and the mounting face of the need frame portion adapted when tightened to engage and secure each and every of said rings upon and against the supporting frame head face on which the rings are mounted.

31. The sling-shot of claim 3, wherein said means for locking and loosening each and every of the said rings in their mounting on the face of the frame head portion are screw means inserted through each and every of said rings into accommodating threaded apertures in the mounting face of said frame head portion adapted when tightened to engage and secure each and all of said rings upon and against the supporting mounting face on the frame head portion on which each of the rings are mounted.

32. Sling-shot comprising, in cooperative assembly:

a body unit having a generally circular and flatly cylindrical frame head portion with mounting faces on each side thereof which is supermounted over and joined with an extending handle grip portion;

said frame head portion being so configured as to form within its confines an opening in the interior space of said frame head portion which opening has adequate dimensional space therein to give free passage of missiles hurled out of and propelled for flight from the sling-shot;

an extensible, elastic sling band mounted in said sling-shot;

at least a single generally arcuately formed sling band bearing collar positioned in fixable but rotatably movable engagement on and against one of the mounting faces of said frame head portion, the inner dimension of each of said collars having at least approximately the dimensional space of said opening in the frame head portion;

each of said collars being concentrically positioned in the assembly with respect to said opening;

the respective disconnected ends of said sling band being mounted upon and securely attached to one of said at least a single collar at oppositely spaced points of securement for said ends on the peripheral area of the said at least a single collar;

means for locking said at least a single collar in predetermined relative disposition placement on the mounting face of said frame head portion on which the said at least a single collar mounting is made; and means for loosening said at least a single collar in the mounting on the face of the frame head portion to permit rotational movement thereof; whereby and whereupon adjustment of the opposed points of securement of said sling band on said at least a single collar may be made so that said points are then rotatably movable wherein they are then disposed if not so positioned so as to generally lie in any plane relative to the general center line passing through the middle of the handle portion of said sling-shot including that plane, during operational usage of the sling-shot, which is at least substantially parallel with the plane of level ground.

33. A sling-shot according to the sling-shot of claim 32, wherein there is a single sling-band bearing collar mounted on one of the mounting faces of said frame head portion and said sling band means is an elastic tube; with there being a pair of mounting pegs provided projecting away from said frame head portion on the flat surface of said sling band means bearing collar which pegs are positioned across from one another;

the diameter of said pegs being greater than the inner diameter of the tubular sling band means and forcible within the open ends of the tube when the sling band means is not extended;

said tubular sling band means being mounted on said bearing collar by having its disconnected ends expandingly force fit respectively over said mounting pegs.

34. A sling-shot according to the sling-shot of claim 32, wherein said sling band is an elastic tube.

35. A sling-shot in accordance with the sling-shot of claim 32, and containing, in addition thereto and in combination therewith, a means for assisting the aiming and sighting of the sling-shot provided on at least one of said sling band bearing collars disposed and located thereon at a fixed peripheral location relative to the opposed points of securement for the disconnected ends of said sling band on and with each of said sling-band bearing collars.

36. A sling-shot in accordance with the sling-shot of claim 32 and containing, in addition thereto and in combination therewith, positioning marks for the centering of said sling band on the outermost visible face of the one or more of said sling band bearing collars in the assembly at the points thereon indicative of and correlated to the points in each and every of the sling band bearing collars mounting at which the disconnected ends of said sling band are mounted in oppositely spaced attachment on the peripheral area of all one or more of said sling-band bearing collars.

* * * * *